US010801674B2

(12) United States Patent
Schmidt et al.

(10) Patent No.: US 10,801,674 B2
(45) Date of Patent: Oct. 13, 2020

(54) RETENTION SYSTEM FOR GAS CYLINDER VALVE

(71) Applicant: Goodrich Corporation, Charlotte, NC (US)

(72) Inventors: Ryan Schmidt, Gilbert, AZ (US); James Baglini, Jr., Chandler, AZ (US); Nick Ruegsegger, Peoria, AZ (US)

(73) Assignee: Goodrich Corporation, Charlotte, NC (US)

( * ) Notice: Subject to any disclaimer, the term of this patent is extended or adjusted under 35 U.S.C. 154(b) by 0 days.

(21) Appl. No.: 16/368,239

(22) Filed: Mar. 28, 2019

(65) Prior Publication Data

US 2019/0219228 A1 Jul. 18, 2019

Related U.S. Application Data

(62) Division of application No. 15/292,507, filed on Oct. 13, 2016, now Pat. No. 10,288,224.

(51) Int. Cl.
*F17C 13/04* (2006.01)
*F17C 1/00* (2006.01)

(52) U.S. Cl.
CPC ..... *F17C 13/04* (2013.01); *F17C 1/00* (2013.01); *F17C 2201/0104* (2013.01); *F17C 2201/0109* (2013.01); *F17C 2201/056* (2013.01); *F17C 2201/058* (2013.01); *F17C 2203/013* (2013.01); *F17C 2203/0604* (2013.01); *F17C 2203/0617* (2013.01); *F17C 2203/0646* (2013.01); *F17C 2203/0656* (2013.01); *F17C 2205/0305* (2013.01); *F17C 2205/0323* (2013.01); *F17C 2205/0338* (2013.01); *F17C 2205/0391* (2013.01); *F17C 2205/0394* (2013.01); *F17C 2205/0397* (2013.01); *F17C 2221/031* (2013.01); *F17C 2223/0123* (2013.01);

(Continued)

(58) Field of Classification Search
CPC ..... F17C 13/04; F17C 2205/0391; F17C 2205/0394; F17C 2205/0397; F17C 2260/042
See application file for complete search history.

(56) References Cited

U.S. PATENT DOCUMENTS 1,799,914 A 4/1931 Lemoine
4,197,966 A * 4/1980 Wadensten ..... B65D 88/703 222/1

(Continued)

FOREIGN PATENT DOCUMENTS

| | | |
|---|---|---|
| CA | 774946 | 1/1968 |
| FR | 2670266 | 4/1993 |
| GB | 2096299 | 10/1982 |

OTHER PUBLICATIONS

European Patent Office, European Search Report dated Feb. 23, 2018 in Application No. 17195539.6-1010.

(Continued)

*Primary Examiner* — Michael R Reid
(74) *Attorney, Agent, or Firm* — Snell & Wilmer L.L.P.

(57) ABSTRACT

A retention assembly for a valve assembly of a charged cylinder may comprise a first fitting coupled to the valve assembly and a second fitting coupled to the charged cylinder. A retaining member may be coupled between the first fitting and the second fitting. The retaining member may be disposed within an interior chamber of the charged cylinder.

4 Claims, 5 Drawing Sheets

(52) U.S. Cl.
CPC .. *F17C 2223/036* (2013.01); *F17C 2250/043* (2013.01); *F17C 2270/0105* (2013.01); *F17C 2270/0189* (2013.01); *F17C 2270/0772* (2013.01)

(56) References Cited

U.S. PATENT DOCUMENTS

| | | | |
|---|---|---|---|
| 4,404,819 | A | 9/1983 | Leonard |
| 4,872,641 | A | 10/1989 | Fangrow, Jr. |
| 5,088,622 | A | 2/1992 | Valy et al. |
| 6,503,584 | B1 | 1/2003 | McAlister |
| 7,089,956 | B1 | 8/2006 | Davidson |
| 9,103,501 | B1 | 8/2015 | Yang |
| 2008/0192805 | A1 | 8/2008 | Harty |

OTHER PUBLICATIONS

USPTO; Restriction Requirement Office Action dated Apr. 3, 2017 in U.S. Appl. No. 15/292,507.
USPTO; Pre-Interview First Office Action dated Sep. 26, 2017 in U.S. Appl. No. 15/292,507.
USPTO; First Action Interview Office Action dated Nov. 22, 2017 in U.S. Appl. No. 15/292,507.
USPTO; Final Office Action dated May 24, 2018 in U.S. Appl. No. 15/292,507.
USPTO; Advisory Action dated Jul. 24, 2018 in U.S. Appl. No. 15/292,507.
USPTO; Notice of Allowance dated Jan. 17, 2019 in U.S. Appl. No. 15/292,507.
US200801 92805 annotated fig3.pdf.
China National Intellectual Property Administration, First Chinese Office Action dated Apr. 22, 2020 in Application No. 201710954751.0.
China National Intellectual Property Administration, Chinese Search Report dated Apr. 16, 2020 in Application No. 201710954751.0.

* cited by examiner

RETENTION SYSTEM FOR GAS CYLINDER VALVE

CROSS-REFERENCE TO RELATED APPLICATIONS

This application is a divisional of, and claims priority to and the benefit of, U.S. Ser. No. 15/292,507 filed Oct. 13, 2016 and entitled "RETENTION SYSTEM FOR GAS CYLINDER VALVE." The above-referenced application is hereby incorporated by reference in its entirety.

FIELD

The present disclosure relates to compressed gas tank assemblies and, more specifically, to retention assemblies for charged cylinders and valves.

BACKGROUND

Various industries, such as automotive, marine, aircraft, medical, sporting equipment, food and beverage, plumbing and electrical industries, may use compressed gas tank assemblies or high-pressure gas cylinders for storage and delivery of pressurized fluid. For example, compressed gas tank assemblies (or inflation cylinders) may be used with aircraft evacuation systems. The changed gas cylinder provides air for life rafts, slides, or other floats to be used in evacuation situations. An inflation source, such as a compressed air cylinder, is typically packed with an evacuation slide within a small space in the aircraft. The charged gas cylinder may be mounted to a packboard or structure within the aircraft fuselage or belly fairing. The charged gas cylinder may be located in a compartment of the fuselage near aircraft hydraulic and/or electrical lines. Movement of the charged gas cylinder may cause damage to other systems within the aircraft. A failure of the valve could allow the charged cylinder or valve to cause damage to nearby systems if not contained.

SUMMARY

A retention assembly for a valve assembly of a charged cylinder is described herein, in accordance with various embodiments. The retention assembly may comprise a first fitting coupled to the valve assembly and a second fitting coupled to the charged cylinder. A retaining member may be coupled between the first fitting and the second fitting. The retaining member may be disposed within an interior chamber of the charged cylinder.

In various embodiments, the first fitting may be coupled to a first port at a first end of the charged cylinder. The second fitting may be coupled to a second port at a second end of the charged cylinder. The retaining member may extend through the interior chamber of the charged cylinder from the first fitting to the second fitting. The retaining member may be cantilever mounted to the valve assembly by the first fitting. The retaining member may include a flange extending radially outward from the retaining member. The flange may be configured to contact the second fitting to limit axial movement of the retaining member and the valve assembly with respect to the charged cylinder. The retaining member may be configured to axially retain the valve assembly proximate the charged cylinder.

A compressed gas system is also provided. The compressed gas system may comprise a charged cylinder defining an interior chamber. A valve assembly may be coupled to the charged cylinder. A retaining member may be coupled to the valve assembly and to the charged cylinder. The retaining member may be disposed within the interior chamber of the charged cylinder.

In various embodiments, the charged cylinder may further comprise a first port and a second port. The valve assembly may be coupled to the first port of the charged cylinder. The valve assembly may be coupled to the second port of the charged cylinder by the retaining member. The retaining member may extend in a longitudinal direction through the interior chamber of the charged cylinder. The retaining member may include a flange extending radially outward from the retaining member. The flange may be configured to contact to limit axial movement of the retaining member and the valve assembly with respect to the charged cylinder. The retaining member may be configured to axially retain the valve assembly proximate the charged cylinder.

A method for retaining a valve assembly to a charged cylinder may comprise coupling the valve assembly to a first port of the charged cylinder, and coupling a retaining member to the valve assembly and to a second port of the charged cylinder.

In various embodiments, the first port and the second port may be disposed at opposing ends of the charged cylinder. The step of coupling the retaining member to the valve assembly may further comprise threading the retaining member to a first fitting coupled to the valve assembly. The step of coupling the retaining member to the valve assembly may further comprise disposing the retaining member within an interior chamber of the charged cylinder. The retaining member may be configured to axially retain the valve assembly proximate the charged cylinder.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the figures, wherein like numerals denote like elements.

DETAILED DESCRIPTION

All ranges and ratio limits disclosed herein may be combined. It is to be understood that unless specifically stated otherwise, references to "a," "an," and/or "the" may include one or more than one and that reference to an item in the singular may also include the item in the plural.

The detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that logical, chemical, and mechanical changes may be made without departing from the spirit and scope of the disclosure. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected, or the like may include permanent, removable, temporary, partial, full, and/or any other possible attachment option. Additionally, any reference to without contact (or similar phrases) may also include reduced contact or minimal contact. Cross hatching lines may be used throughout the figures to denote different parts but not necessarily to denote the same or different materials.

Charged cylinder valves may be contained, by a retention assembly, to a compressed gas cylinder in order to prevent the valve from leaving the cylinder in the event of a valve or cylinder (tank) failure. The retention assembly may also prevent the charged cylinder from creating significant enough thrust to become a projectile. As used herein, "inflation cylinder" and "compressed gas tank" are used interchangeably.

Figure 1:
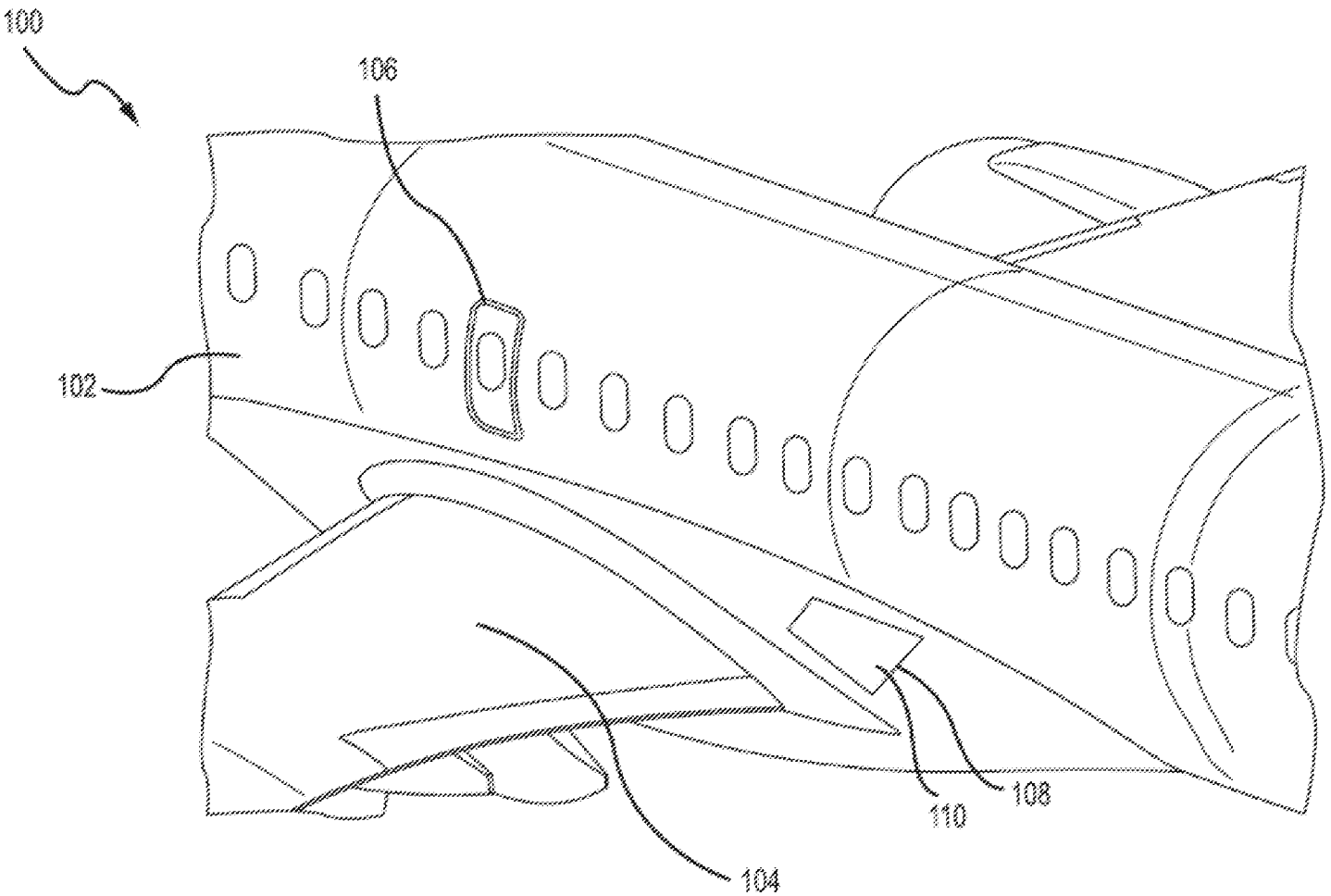
FIG. 1 illustrates an exemplary aircraft with an evacuation system, in accordance with various embodiments.

Referring to FIG. 1, an aircraft 100 is shown, in accordance with various embodiments. The present disclosure describes composite compressed gas systems and charge cylinder valves with respect to inflatable evacuation systems of an aircraft 100, however, it will be understood the systems and methods of the present disclosure may be suitable for use in other systems having compressed gas systems. Aircraft 100 may comprise a fuselage 102 with wings 104 fixed to fuselage 102. Emergency exit door 106 may be disposed on fuselage and an evacuation system 108 may be stored, for example, in an undeployed condition in a packboard housing inside the fuselage of aircraft 100. A panel 110 may cover evacuation system 108 when installed within aircraft 100. Evacuation system 108 may jettison panel 110 and deploy an inflatable device, such as an inflatable slide, in response to emergency exit door 106 opening. Evacuation system 108 may include a compressed gas system 112 coupled to an inflatable device 114 and configured to inflate the inflatable device 114 (see FIG. 2).

Figure 2:
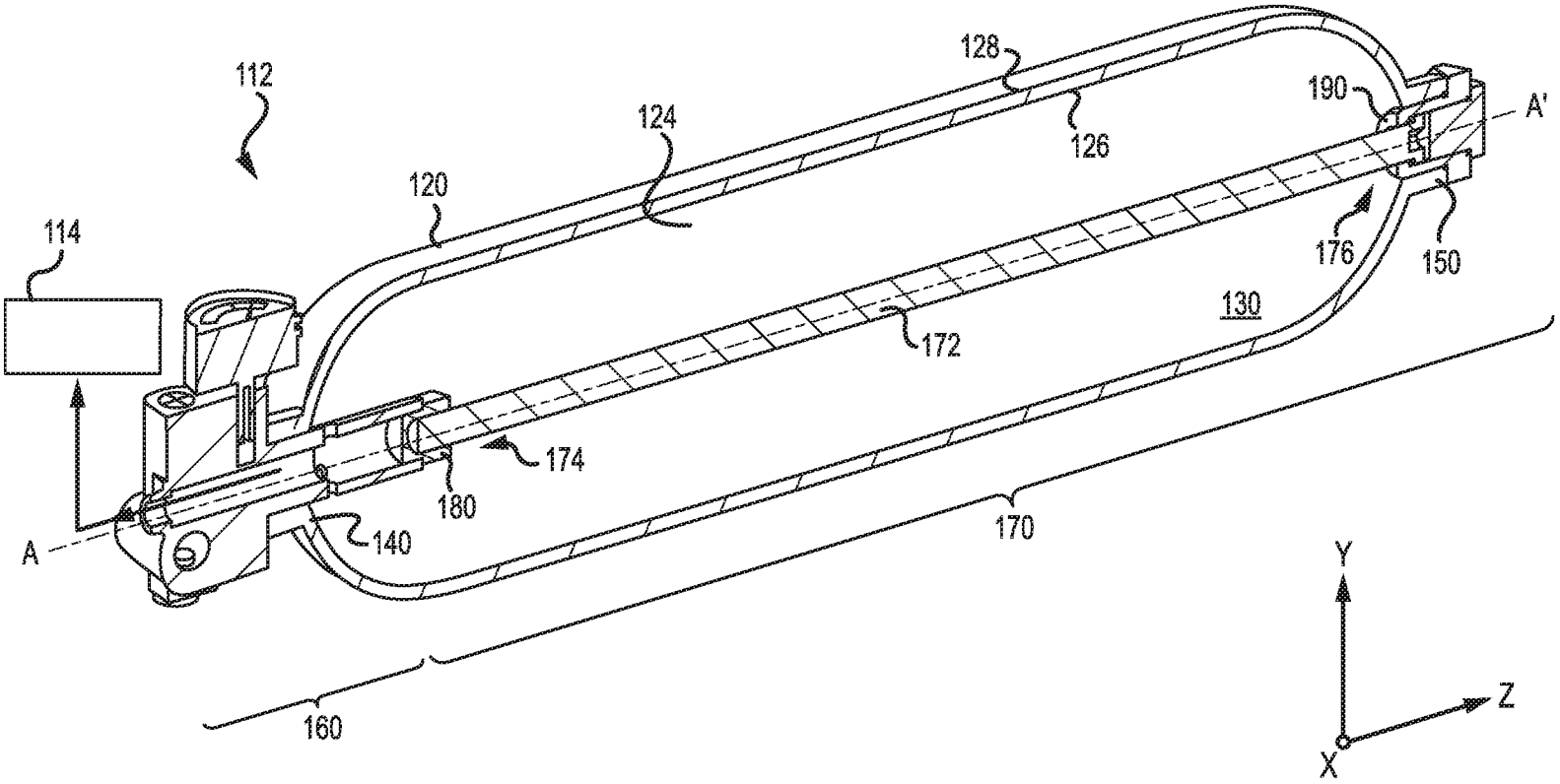
FIG. 2 illustrates an isometric cross section of an inflation system with a valve retention assembly, in accordance with various embodiments.

Referring to FIG. 2, a compressed gas system 112 including a valve retention assembly is shown, in accordance with various embodiments. Compressed gas system 112 includes a charged cylinder 120 configured to hold a gas mixture 124 that is under pressure. Charged cylinder 120 may include a metal liner 126 that defines an interior chamber 130 of the charged cylinder 120. Metal liner 126 may comprise any suitable metal, for example aluminum and/or aluminum alloys. A composite shell 128 may be disposed on the outer surface of the metal liner 126. Composite shell 128 may comprise one or more shells made of carbon fiber and/or other types of materials including composites (such as fiber reinforced polymers), nano-fabrics, and nano-materials. Composite shell 128 may include a fiberglass shell disposed on an outer surface of a carbon fiber shell. An epoxy resin may be used to adhere composite shell 128 to metal liner 126. Composite shell 128 and metal liner 126 may comprise the wall of charged cylinder 120.

Charged cylinder 120 may define interior chamber 130, which may be filled with a fluid, such as compressed gases and/or compressed liquids. In various embodiments, the fluid within charged cylinder 120 may be configured to be pressurized to about 4,000 pounds per square inch gauge (psig) or greater, where the term "about" in this context only means+/−100 psig. Compressed gas system 112 may be in fluid communication with an inflatable device 114 (shown schematically). Although compressed gas system 112 is depicted as an inflation cylinder for inflatable device 114, it should be understood that the concepts described herein are not limited to use with inflatable devices as the teachings may be applied to other charged cylinders for use in non-aircraft systems as well.

Charged cylinder 120 may comprise a first port 140 and a second port 150 disposed at opposite axial ends of charged cylinder 120. First port 140 may be disposed at a proximal end, or a first end, of charged cylinder 120, and second port 150 may be disposed at a distal end, or a second end, of charged cylinder 120. The first end of charged cylinder 120 may be opposite to the second end of charged cylinder 120. As used herein, "distal" refers to the direction away from inflatable device 114, or generally, in the positive z-direction on the provided xyz axis relative to the charged cylinder 120. As used herein, "proximal" refers to a direction toward or near to inflatable device 114, or generally, in the negative z-direction on the provided xyz axis relative to the charged cylinder 120. Charged cylinder 120 is illustrated having a longitudinal axis A-A' oriented along an axial length of charged cylinder 120, parallel to the z-direction on the provided xyz axis.

First port 140 and second port 150 may each comprise an extruded boss or cylindrical boss extending from and/or integrally formed with charged cylinder 120. First port 140 and second port 150 may define apertures or openings in charged cylinder 120. First port 140 and second port 150 may have a similar or same size and shape and may be aligned along the longitudinal axis A-A' of charged cylinder 120. First port 140 and second port 150 may be internally threaded. Although first port 140 and second port 150 are shown in FIG. 2 as having internal threading, it will be understood that, according to various embodiments, the disclosure herein is equally as applicable to cylinders with charge/discharge ports having external threading.

Compressed gas system 112 may include a valve assembly 160 coupled to charged cylinder 120 at one of first port 140 or second port 150. Valve assembly 160 may include a regulator valve assembly for regulating a pressure of gas mixture 124 within interior chamber 130. Valve assembly 160 is shown, for example, in FIG. 2 coupled to first port 140. First port 140 may be used to charge the charged cylinder 120 with a fluid and may also be used to discharge the charged cylinder 120 of fluid. Compressed gas system 112 may provide pressurized gas to inflatable device 114 through first port 140 and valve assembly 160. Valve assembly 160 may couple to first port 140 and may be configured to maintain a release pressure of the gas mixture 124 as it exits the charged cylinder 120 to inflate an inflatable device 114. Additional components (not depicted) can be disposed between the valve assembly 160 and the inflatable device 114, such as tubing, an aspirator, and/or other elements. The inflatable device 114 can be, for example, a slide, raft, slide/raft combination or other inflatable device or system configured to receive compressed fluid.

Charged cylinder 120 may further include a valve retention assembly 170 configured to retain valve assembly 160 in a position proximate to charged cylinder 120. Valve retention assembly 170 may include a retaining member 172 disposed internally with respect to charged cylinder 120. Retaining member 172 may extend in a longitudinal direction, i.e. parallel to longitudinal axis A-A', through a length of interior chamber 130 and may couple to valve assembly 160 and to second port 150. Retaining member 172 may include a proximal end 174 and a distal end 176. Proximal end 174 of retaining member 172 may couple to valve assembly 160 via a first fitting 180. Distal end 176 of retaining member 172 may further couple to second port 150 via a second fitting 190. The attachment of retaining member 172 to both valve assembly 160 and to second port 150 operates to mechanically retain valve assembly 160 to charged cylinder 120.

In various embodiments, retaining member 172 may be configured to carry a tensile load. Retaining member 172 is illustrated as a rod having solid structure in FIG. 2A, however, other configurations of a retaining member 172 may be used to retain valve assembly 160 to charged cylinder 120. Retaining member 172 may be a rigid or flexible member capable of carrying a tensile load, such as a tube, cable, or other coupling. Further, a length of retaining member 172 may be configured or selected according to a size and/or length of charged cylinder 120.

Figure 3A:
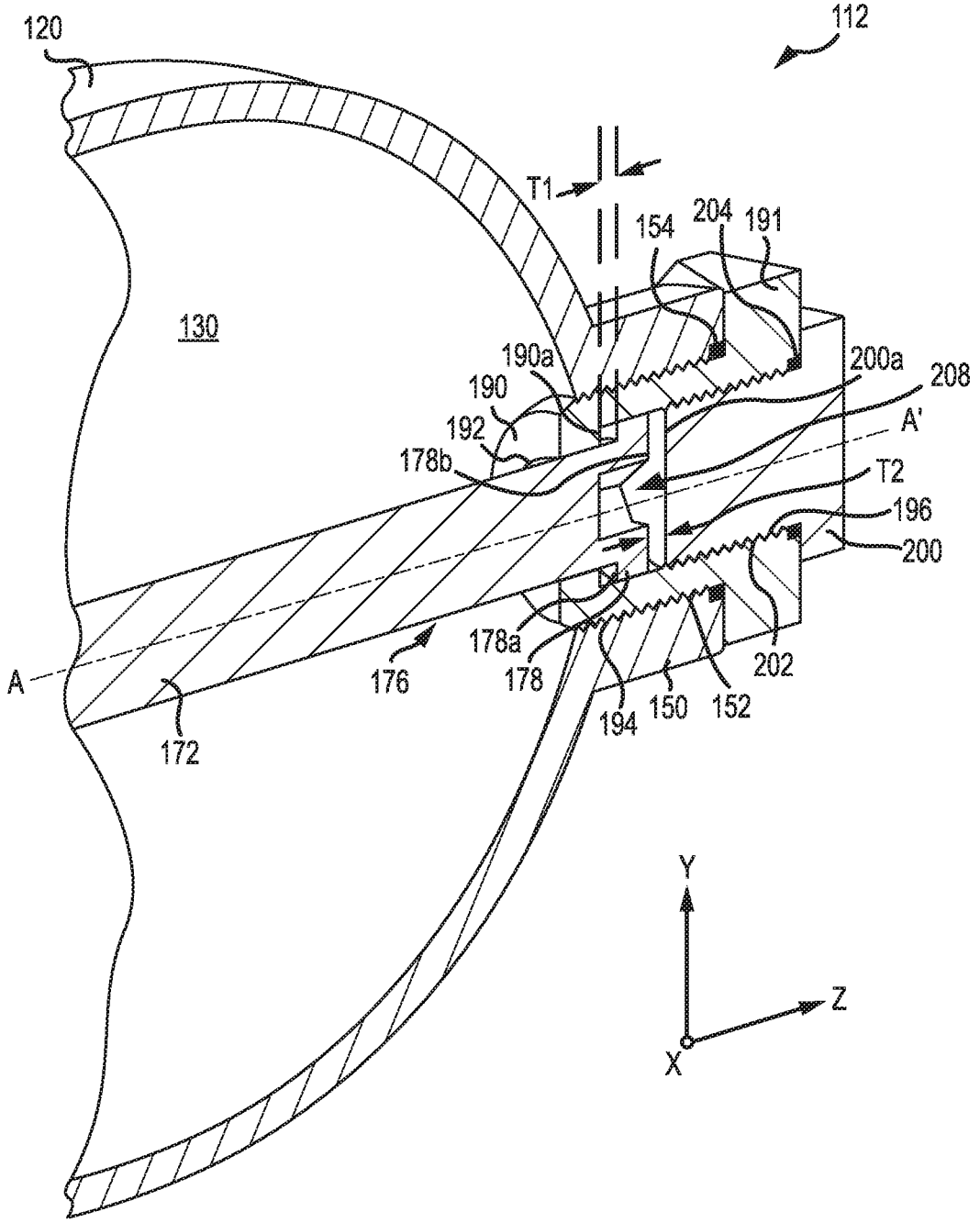
FIGS. 3A and 3B illustrate a valve retention assembly, in accordance with various embodiments.

Referring now to FIG. 3A, additional detail of second port 150 of charged cylinder 120 of compressed gas system 112 is shown, in accordance with various embodiments. Valve retention assembly 170 of compressed gas system 112 may include a second port 150 configured to receive second fitting 190, which may be configured to receive retaining member 172. Second fitting 190 may have cup shape with a generally u-shaped cross section and flange 191. A proximal portion of second fitting 190 may define an opening 192. Opening 192 may be configured to receive retaining member 172, which extends through opening 192. A diameter of opening 192 may be greater than a diameter of retaining member 172, such that retaining member 172 is movable along longitudinal axis A-A' with respect to second fitting 190.

In various embodiments, a distal end 176 of retaining member 172 may comprise a flange 178. Flange 178 may extend radially outward from retaining member 172 and may comprise a circumferential flange. Flange 178 interfaces with second fitting 190 to limit axial movement of retaining member 172 in the negative z-direction. During assembly, retaining member 172 may be inserted, leading with proximal end 174 (see FIG. 2) through opening 192, into charged cylinder 120.

In various embodiments, second fitting 190 may fit within second port 150 and may threadingly couple to second port 150. Second fitting 190 may include outer threading 194 configured to couple with an inner threading 152 of second port 150. An O-ring seal 154 may be disposed between second fitting 190 and second port 150 to form a fluid seal.

Valve retention assembly 170 may further include an end cap 200 coupled to second fitting 190. End cap 200 may fit within second fitting 190 and may threadingly couple to second fitting 190. End cap 200 may include outer threading 202 configured to couple with an inner threading 196 of second fitting 190. An O-ring seal 204 may be disposed between second fitting 190 and end cap 200 to form a fluid seal. End cap 200 and second fitting 190 may together form a plug for sealing second port 150 of charged cylinder 120. O-ring seals 154, 204 may fluidly seal interior chamber 130 of charged cylinder 120 at second port 150.

Distal end 176 of retaining member 172 with flange 178 may be positioned within second fitting 190 such that a tolerance or a first gap T1 may be defined between a proximal surface 178*a* of flange 178 and a surface 190*a* of second fitting 190. Distal end 176 of retaining member 172 and end cap 200 may be positioned within second fitting 190 such that a tolerance or a second gap T2 may be defined between a distal surface 178*b* of flange 178 and a proximal surface 200*a* of end cap 200. Retaining member 172 and flange 178 may not be fixedly attached to second fitting 190 or end cap 200. First gap T1 permits limited axial movement of retaining member 172 in the negative z-direction, and second gap T2 permits limited axial movement of retaining member 172 in the positive z-direction. First gap T1 and second gap T2 provide a tolerance for adjusting an axial position of retaining member 172. In various embodiments, distal end 176 of retaining member 172 comprises a tooling interface 208 configured to permit adjustment of retaining member 172. For example, tooling interface 208 may include hexagonal driver which can be used to turn or screw retaining member 172 with respect to first fitting 180 (see FIG. 3B), thereby moving retaining member 172 in an axial direction along longitudinal axis A-A'. An axial position of retaining member 172 may be adjusted using tooling interface 208 to rotate retaining member 172 about longitudinal axis A-A'. As retaining member 172 rotates, retaining member 172 translates along longitudinal axis A-A' by threading in or out of first fitting 180 (see FIG. 3B).

Figure 3B:
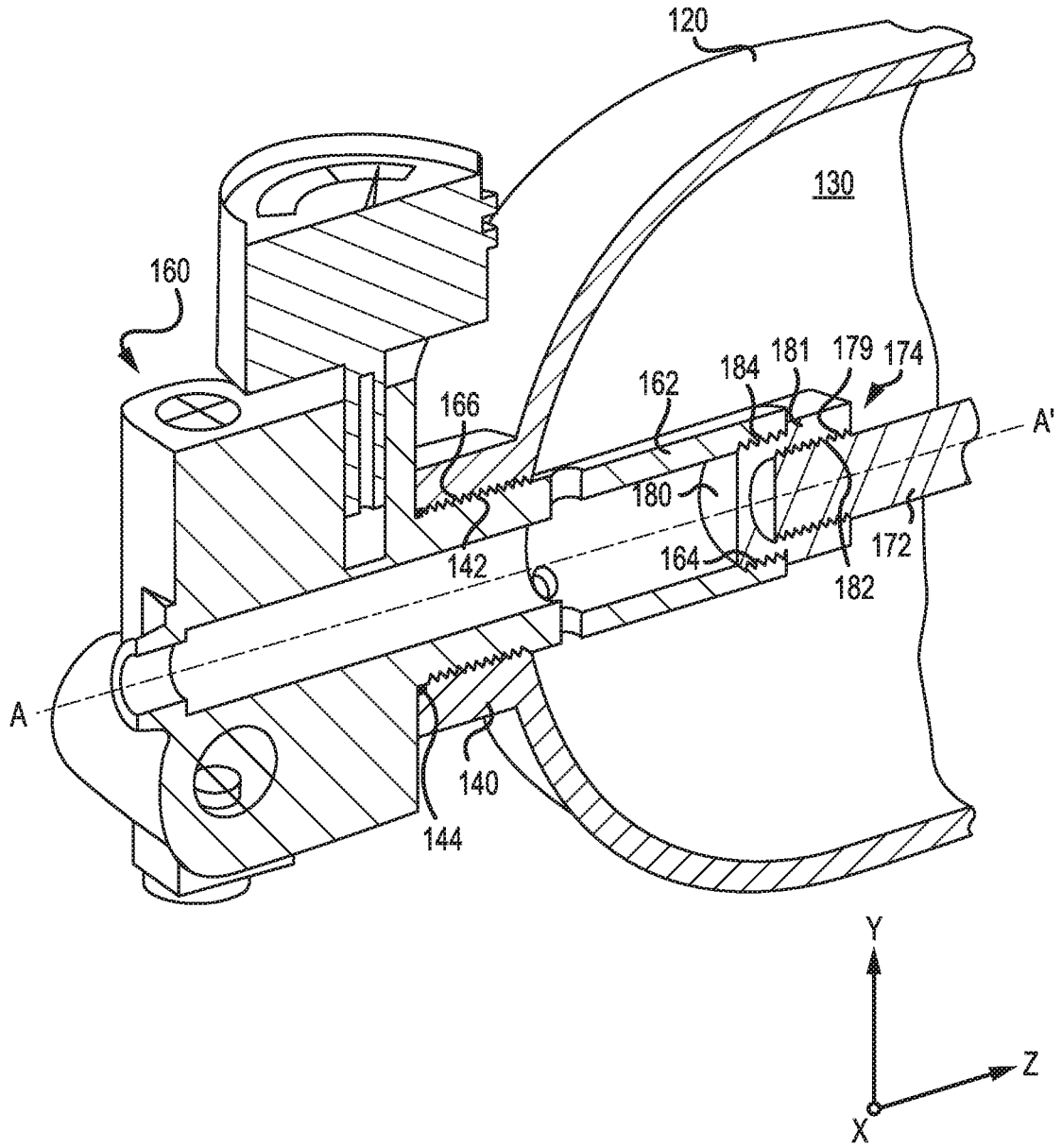

Referring to FIG. 3B, additional detail of first port 140 of charged cylinder 120 of compressed gas system 112 is shown, in accordance with various embodiments. Compressed gas system 112 may include a first port 140 configured to receive first fitting 180, which may be configured to receive retaining member 172 of valve retention assembly 170. Retaining member 172 may couple to valve assembly 160 through first fitting 180. First fitting 180 may have cup shape with a generally u-shaped cross section and flange 181. First fitting 180 may define a chamber which may receive retaining member 172 from a distal side of first fitting 180. Retaining member 172 may fit within first fitting 180, which may fit within a stem 162 of valve assembly 160.

Valve retention assembly 170 may include first fitting 180 configured to couple valve assembly 160 to retaining member 172. A proximal end 174 of retaining member 172 may include threading 179 configured to couple with an inner threading 182 of first fitting 180. First fitting 180 may further include outer threading 184 configured to couple with an inner threading 164 of stem 162. Retaining member 172 may extend distally (i.e., in the negative z-direction) in a cantilever manner from first fitting 180. First fitting 180 interfaces with retaining member 172 and valve assembly 160 to limit axial movement of retaining member 172 in the negative z-direction. First fitting 180 may hold retaining member 172 in a rigid axial position with respect to valve assembly 160. In various embodiments, first fitting 180 may be retrofitted onto valve assemblies 160. Charged cylinder valve assemblies may be retrofitted by adding valve retention assembly 170 at a lower cost than the cost to produce new valve assemblies.

In various embodiments, a stem 162 of valve assembly 160 extends through first port 140 into interior chamber 130. Stem 162 of valve assembly 160 may fit within first port 140 and may threadingly couple to first port 140. Stem 162 may include outer threading 166 configured to couple with an inner threading 142 of first port 140. An O-ring seal 144 may be disposed between first port 140 and stem 162 to form a fluid seal. O-ring seal 144 may fluidly seal interior chamber 130 of charged cylinder 120 at first port 140.

In various embodiments, stem 162 of valve assembly 160 threaded into inner threading 142 of first port 140 may operate as a primary retention assembly for valve assembly 160. In the event the coupling between stem 162 and first port 140 fails to hold valve assembly 160 in place with respect to charged cylinder 120, valve retention assembly 170 may operate as a secondary retention assembly for valve assembly 160. Thus, valve retention assembly 170 provides redundancy in mechanical retention of valve assembly 160 to charged cylinder 120.

With reference now to FIGS. 3A and 3B, valve retention assembly 170 provides a redundant retention system for retaining valve assembly 160 proximate to charged cylinder 120. As discussed, retaining member 172 may be coupled within charged cylinder 120 by cantilever attachment, with proximal end 174 as a fixed end and distal end 176 as a free end. Distal end 176 of retaining member 172 may be configured with a first gap T1 and a second gap T2 during normal operation of valve assembly 160. Thus, during normal operation, retaining member 172 may not apply a tensile force to valve assembly 160. In an event that causes valve assembly 160 to detach from first port 140 and move axially away from charged cylinder 120 (i.e., in the negative z-direction), retaining member 172 moves in the negative z-direction with valve assembly 160 for a limited distance, i.e. a distance of first gap T1, until flange 178 of retaining member 172 contacts second fitting 190. Second fitting 190 prevents flange 178 from moving beyond the distance of first gap T1 by operating as a mechanical barrier to flange 178. Retaining member 172 is held in place axially by flange 178, and thus retaining member 172 holds valve assembly 160 proximate the charged cylinder 120.

Figure 4:
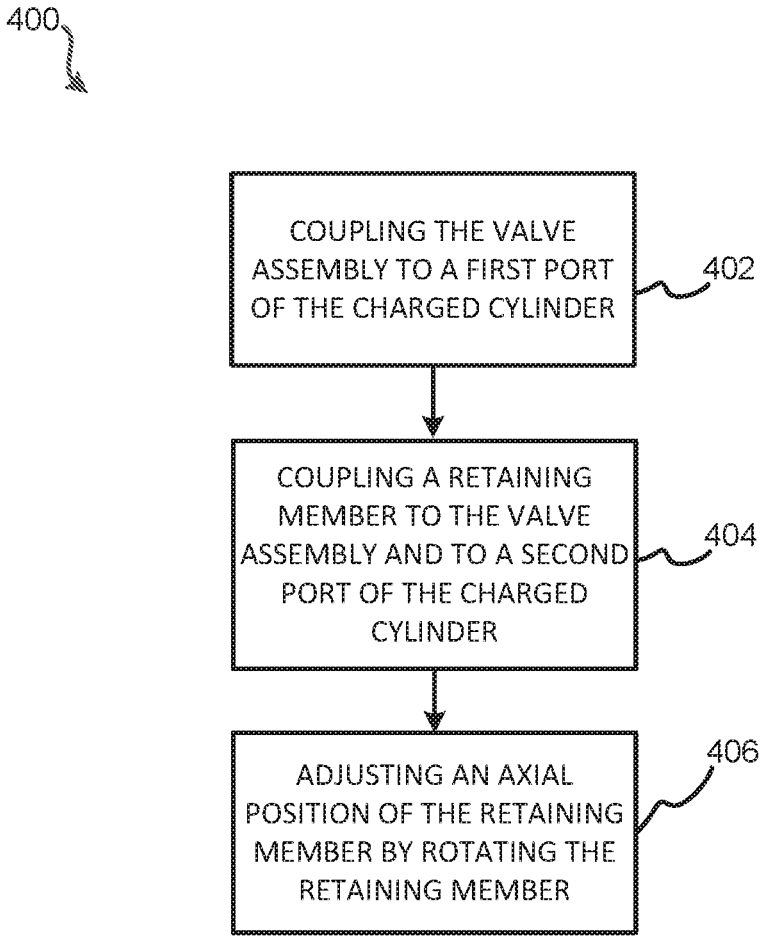
FIG. 4 illustrates a method for retaining a valve to a charged cylinder, in accordance with various embodiments.

With reference to FIG. 4, a method 400 for retaining a valve assembly to a charged cylinder is shown, in accordance with various embodiments. Method 400 may comprise the steps of coupling a valve assembly to a first port of a charged cylinder (step 402), coupling a retaining member to the valve assembly and to a second port of the charged cylinder (step 404), and adjusting an axial position of the retaining member by rotating the retaining member (step 406). The first port 140 and second port 150 may be disposed at opposing ends of the charged cylinder 120. The retaining member 172 may be configured to limit movement of the valve assembly 160 in a direction away from the charged cylinder 120. The retaining member 172 may be configured to axially retain the valve assembly 160 proximate the charged cylinder.

Step 402 may further comprise threading valve assembly 160 to first port 140. The method may further include coupling valve assembly 160 to second port 150 through retaining member 172 and one or more fittings. Step 404 may further comprise disposing the retaining member 172 within an interior chamber 130 of the charged cylinder 120. Step 404 may further comprise threading the retaining member 172 to a first fitting 180 coupled to the valve assembly 160. Step 404 may further comprise threading first fitting 180 to a stem 162 of the valve assembly 160.

Step 406 may further comprise adjusting an axial position of retaining member 172 with respect to valve assembly 160 by rotating retaining member 172 about longitudinal axis A-A'. Retaining member 172 may be adjusted through second port 150 and may be adjusted after retaining member 172 is installed within interior chamber 130 of the charged cylinder 120.

Benefits and other advantages have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, and any elements that may cause any benefit or advantage to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

We claim:

1. A method for retaining a valve assembly to a charged cylinder, comprising:

coupling the valve assembly to a first port of the charged cylinder, the valve assembly including a first fitting;

inserting a retaining member into a second port, the retaining member including a flange extending radially outward from the retaining member, the flange contacting a second fitting in response to inserting the retaining member into the second port; and coupling the retaining member to the first fitting of the valve assembly and to the second port of the charged cylinder by rotating the retaining member to thread the retaining member to the first fitting.

2. The method of claim 1, wherein the first port and the second port are disposed at opposing ends of the charged cylinder.

3. The method of claim 1, wherein the coupling the retaining member to the valve assembly further comprises disposing the retaining member within an interior chamber of the charged cylinder.

4. The method of claim 1, wherein the retaining member is configured to axially retain the valve assembly proximate the charged cylinder.

* * * * *